US008141631B2

(12) United States Patent
Chouzenoux et al.

(10) Patent No.: US 8,141,631 B2
(45) Date of Patent: Mar. 27, 2012

(54) DEPLOYMENT OF UNDERGROUND SENSORS IN CASING

(75) Inventors: Christian Chouzenoux, St. Cloud (FR); Brian Clark, Sugar Land, TX (US); Yves Manin, Le Plessis Robinson (FR); Bruno Drochon, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 689 days.

(21) Appl. No.: 11/571,021

(22) PCT Filed: Jun. 21, 2005

(86) PCT No.: PCT/EP2005/006863

§ 371 (c)(1),
(2), (4) Date: Aug. 13, 2008

(87) PCT Pub. No.: WO2006/000438

PCT Pub. Date: Jan. 5, 2006

(65) Prior Publication Data

US 2008/0308271 A1 Dec. 18, 2008

(30) Foreign Application Priority Data

Jun. 23, 2004 (EP) ..... 04291587

(51) Int. Cl.
*E21B 47/00* (2006.01)

(52) U.S. Cl. ..... 166/250.01; 166/66

(58) Field of Classification Search ..... 166/66, 166/250.01

See application file for complete search history.

(56) References Cited

U.S. PATENT DOCUMENTS

| | | | | |
|---|---|---|---|---|
| 4,790,380 | A * | 12/1988 | Ireland et al. | 166/250.07 |
| 5,576,703 | A * | 11/1996 | MacLeod et al. | 340/854.4 |
| 6,679,332 | B2 * | 1/2004 | Vinegar et al. | 166/373 |
| 7,140,434 | B2 * | 11/2006 | Chouzenoux et al. | 166/250.11 |
| 2003/0058127 | A1 * | 3/2003 | Babour et al. | 340/854.3 |
| 2003/0098799 | A1 * | 5/2003 | Zimmerman | 340/854.6 |

FOREIGN PATENT DOCUMENTS

| | | | |
|---|---|---|---|
| GB | 2353546 | * | 2/2001 |
| GB | 2366578 | * | 3/2002 |
| RU | 2077735 | | 4/1997 |
| RU | 2211311 | | 1/2001 |
| SU | 459585 | | 5/1975 |
| SU | 872743 | | 10/1981 |
| WO | WO 773345 | * | 5/1997 |

* cited by examiner

*Primary Examiner* — Hoang Dang
(74) *Attorney, Agent, or Firm* — Matthias Abrell

(57) ABSTRACT

The present disclosure discloses a subsurface formation fluids monitoring system, and a method thereof, integrated on a casing or tubing sub having an inner and an outer surface and defining an internal cavity. The system also includes a sensor mounted on the outer surface and wireless data communication between an interrogating tool located in the internal cavity and the sensor. The system also able to provide fluid communication between the sensor and fluids of the formation with a tool that can be moved through the well to a number of locations.

33 Claims, 14 Drawing Sheets

DEPLOYMENT OF UNDERGROUND SENSORS IN CASING

FIELD OF THE INVENTION

This present invention relates to methods of deploying underground sensors and to systems and apparatus utilizing underground sensors. In particular, the invention relates to such methods, systems and apparatus for making underground formation pore pressure measurements.

DESCRIPTION OF THE PRIOR ART

During the production of fluids such as hydrocarbons and/or gas from an underground reservoir, it is important to determine the development and behavior of the reservoir, firstly to allow production to be controlled and optimized and secondly to foresee changes which will affect the reservoir. Formation pressure measurement is one of the basic measurements made on a formation to determine the properties of an underground reservoir, and these measurements are well known in the prior art.

When a well is first drilled, it is relatively easy to make such a measurement by placing a probe in contact with the borehole wall and using the probe to sense the pressure of fluids in the formation. Those measurements are made by means of a tool that is lowered into the well via a wireline cable and logged through the well on this cable and removed finally from the well when measurements are completed. Because such tools are relatively large and expensive, we do not leave them in the well for any period of time.

After a completion is realized, by installing typically a liner or casing into the well. Normally this casing is made of steel and is fixed into the well by cement that is placed in the annulus between the outer surface of the casing and the borehole wall. This completion provides a physical support to the well to prevent it collapsing or becoming eroded by flowing fluids. Nevertheless, completion do not facilitate access to the formation for making pressure measurements, and therefore various approaches have been proposed to enable measurements to be made on formations:

In U.S. Pat. No. 6,234,257 and U.S. Pat. No. 6,070,662, a sensor is disposed inside a shell, which is forced into the formation thanks to an explosive charge or a logging tool that will perforate the casing. The sensor can then be interrogated by means of an antenna, which can communicate through an aperture provided in the casing.

SPE 72371 describes a tool, which allows pressure testing of the formation after completion of the well. The tool drills a hole through the casing and cement to the formation and places a probe to sense the formation pressure. Once the measurement is complete, a plug is placed in the drilled hole to ensure sealing of the casing.

U.S. Pat. No. 5,467,823 and WO 03 100218 disclose a permanent sensor installed on the outside of the casing to allow long term monitoring of formation pressure. Nevertheless, when deploying an array of permanent sensors, the presence of cable outside casing might create a channel in the cement. If this occurs, this channel will create cross-flow between the sensors array leading to a misleading pressure tests analysis. Besides, the presence of cable outside casing does allow casing reciprocating and rotation, which is often a required operation to achieve a good cement job.

SUMMARY OF THE INVENTION

The present invention discloses a monitoring system integrated on a casing or tubing sub having an inner and an outer surface and defining an internal cavity, comprising a sensor; data communication means for providing wireless communication between an interrogating tool located in the internal cavity and the sensor, these data communication means being located on the casing or tubing sub; and power communication means for providing wireless power supply to the sensor, these power communication means being located on the casing or tubing sub.

The data and power communication means can be located on the inner surface, on the outer or between the surfaces of the casing or tubing sub.

The data communication means and the power communication means can be associated in one, to miniaturize the casing or tubing sub and reduce the connecting means between the different functional elements. In a preferred embodiment, this communication mean is an electromagnetic antenna, as a toroidal antenna based on electromagnetic coupling for power transfer and data communication.

Preferably, the sensor is mounted on the outer surface. The sensor typically further comprises an electronics package in a protective housing connecting the sensing elements and the communication elements including a signal processing unit receiving data from the sensor; and a power recovery/delivery unit delivering power supply to the sensor. Therefore in one aspect of the invention, the sensor functionalizes when the interrogating tool located in the internal cavity provides wireless power supply and loads measurements made by the sensor.

In a second aspect of the invention, the sensor functionalizes more autonomously and further comprises in the electronics package: a wireless transmission and reception communication unit, a programmable micro-controller and memory unit, and a power storage unit. The interrogating tool is used to load measured and stored data, additionally to reprogram the micro-controller and additionally to recharge the power storage unit when this one is a battery.

In a preferred embodiment, the casing or tubing sub further comprises coupling means for providing fluid communication between the sensor and the fluids of the formation and pressing means for ensuring contact between the coupling means and the formation. Those coupling and pressing means ensure hydraulic coupling to the formation fluids, necessary to perform valid measurement of the properties of the reservoir.

In another preferred embodiment, the casing or tubing sub further comprises coupling means for providing fluid communication between the sensor and the fluids inside the well.

The coupling mean is preferably one element selected from the list:

- a material with high permeability, as high permeable resin or permeable cement;
- an integrated device releasing a substance to prevent curing during the setting of the cement;
- an integrated device releasing a substance to increase the permeability of the cement during the setting of the cement;
- an integrated device releasing a substance to change the coefficient of expansion of the cement during curing; and
- an integrated device creating shear waves that induce cracks in the cement during curing.

The sensors are preferably sensitive to one or more of the following: pressure, temperature, resistivity, conductivity, stress, strain, pH and chemical composition.

For a sensor comprising pressure sensing elements, the casing sub can include a pressure chamber having a pressure port that allows fluid pressure communication between the outside of the casing sub and the pressure chamber, wherein the pressure sensing elements are located inside a protection and coupling mechanism which separates the pressure sensing elements from fluid inside the pressure chamber but transmits changes in pressure of the fluid in the pressure chamber to the sensing elements. The protection and coupling mechanism preferably comprises fluid-filled bellows surrounding the sensing elements.

According to another aspect, the invention provides a method of completing a well comprising the steps of: installing a casing containing at least one casing sub as described above; cementing the outer surface of the casing in position; and providing fluid communication between the sensor and the reservoir.

According to another aspect, the invention provides a method of completing a well comprising the steps of: installing a tubing with an upper and a lower part, the tubing containing at least one tubing sub as described above. The method can further comprise the step of insulating a part of the casing and/or tubing with an insulated gap which insulates electrically the upper part of the casing and/or tubing from the lower part of the casing and/or tubing. The insulation is realized with a ceramic coated pin located between the upper part of the casing and/or tubing and the lower part of the casing and/or tubing.

In one embodiment, the fluid communication between the sensor and the reservoir is provided thanks to the cited integrated coupling and pressing means.

In other embodiment, the fluid communication between the sensor and the reservoir is provided thanks to a wireline tool moving in the internal cavity through the well to a number of locations.

In other embodiment, the method of completing further comprises the step of positioning an interrogating tool permanently in the internal cavity, the interrogating tool ensuring wireless signal communication with the sensor, wherein signal is of data or power type.

According to a further aspect, the invention provides a method of monitoring subsurface formations containing at least one fluid reservoir and traversed by at least one well equipped with a casing or tubing sub as described above, the sensor measuring a parameter related to the formation fluids and comprising the step of establishing a wireless signal communication between the sensor and the interrogating tool, wherein signal is of data or power type.

According to a further aspect, the invention provides a method of monitoring at least one fluid inside a well, said well being equipped with a casing or tubing sub as described above, the sensor measuring a parameter related to the fluid and comprising the step of establishing a wireless signal communication between the sensor and the interrogating tool, wherein signal is of data or power type.

According to a further aspect, the invention provides a method of monitoring subsurface formations containing at least one fluid reservoir and traversed by at least one well equipped with a casing or tubing sub as described above, wherein the sensor measures a parameter related to the formation fluids; the method: monitoring variation in the measurements made by the sensor over time with the interrogating tool located in the internal cavity, said interrogating tool delivering power supply and unloading the measurements to the surface; and inferring formation properties from the time varying measurements.

According to a further aspect, the invention provides a method of monitoring subsurface formations containing at least one fluid reservoir and traversed by at least one well equipped with a casing or tubing sub as described above, wherein the sensor measures a parameter related to the formation fluids; the method: monitoring variation in the measurements made by the sensor over time; loading the measurements to the surface with the interrogating tool located in the internal cavity and inferring formation properties from the time varying measurements.

According to a further aspect, the invention provides a method of monitoring at least one fluid inside a well, said well being equipped with a casing or tubing sub as described above, wherein the sensor measures a parameter related to the fluid; the method: monitoring variation in the measurements made by the sensor over time with the interrogating tool located in the internal cavity, said interrogating tool delivering power supply and unloading the measurements to the surface; and inferring formation properties from the time varying measurements.

According to a further aspect, the invention provides a method of monitoring at least one fluid inside a well, said well being equipped with a casing or tubing sub as described above, wherein the sensor measures a parameter related to the fluid; the method: monitoring variation in the measurements made by the sensor over time; loading the measurements to the surface with the interrogating tool located in the internal cavity and inferring formation properties from the time varying measurements.

According to a further aspect, the invention provides a method of monitoring casing or tubing inside a well, said well being equipped with a casing or tubing sub as described above, wherein the sensor measures a parameter related to the casing or tubing properties; the method: monitoring variation in the measurements made by the sensor over time with the interrogating tool located in the internal cavity, said interrogating tool delivering power supply and unloading the measurements to the surface; and inferring formation properties from the time varying measurements.

According to a further aspect, the invention provides a method of monitoring casing or tubing inside a well, said well being equipped with a casing or tubing sub as described above, wherein the sensor measures a parameter related to the casing or tubing properties; the method: monitoring variation in the measurements made by the sensor over time; loading the measurements to the surface with the interrogating tool located in the internal cavity and inferring formation properties from the time varying measurements.

In a preferred embodiment, the method further comprises the step of recharging the battery and reprogramming the micro-controller.

BRIEF DESCRIPTION OF THE DRAWINGS

Further embodiments of the present invention can be understood with the appended drawings.

DETAILED DESCRIPTION

Figure 1:
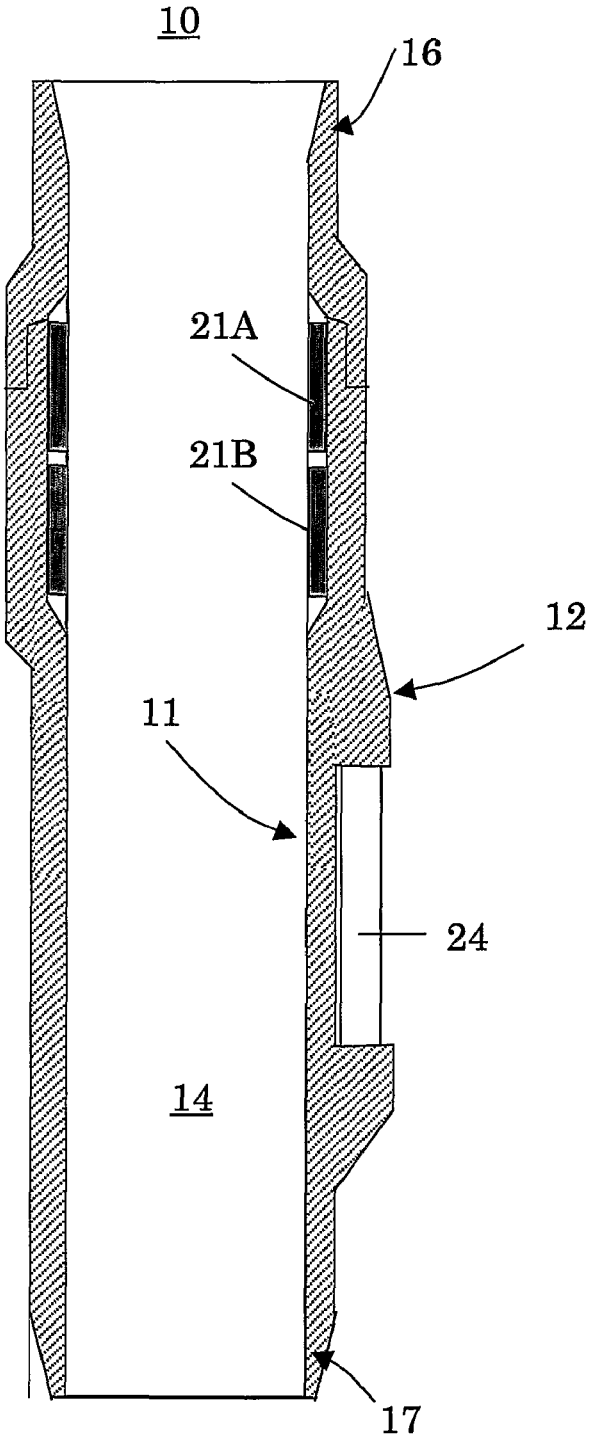
FIG. 1 illustrates the casing sub according to the invention.
Figure 2:
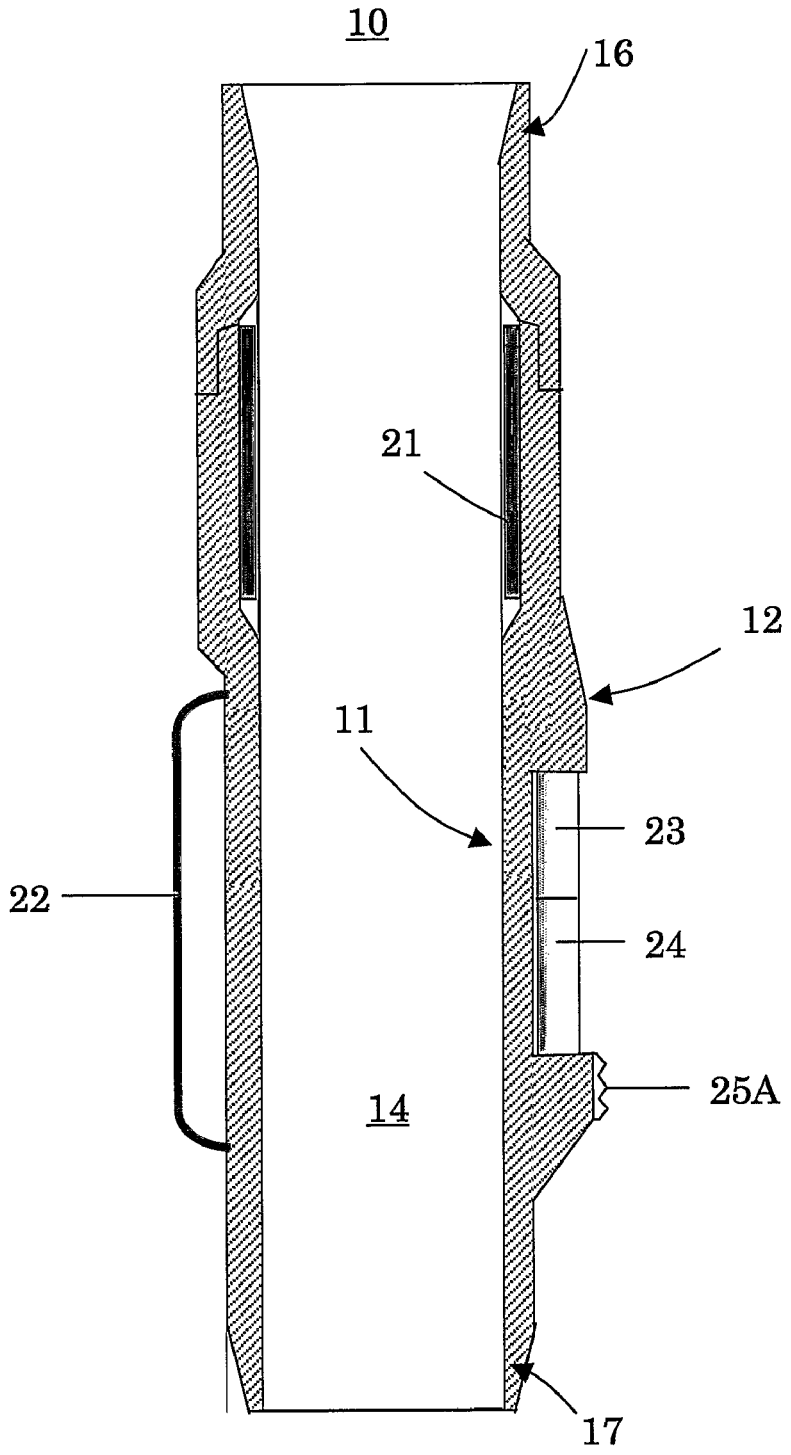
FIG. 2 illustrates the casing sub according to a further aspect of the invention.

FIGS. 1 and 2 illustrate a casing sub, identified as a whole by the numeral 10 and containing a miniaturized and integrated device for monitoring underground formation. The design of the casing sub contains standard casing connecting threads (an upper box-end 16 and lower pin-end 17) allowing assembly of the casing in parts. The casing sub defines an inner surface 11, an outer surface 12 and an internal cavity 14. In FIG. 1, according to the invention, the casing sub contains a sensor 24 mounted on the outer surface. A data communication means 21A and a power communication means 21B are mounted between the inner and the outer surface in the thickness of the casing.

In FIG. 2, according to the invention, the casing sub contains a sensor 24 mounted on the outer surface and a toroidal antenna 21 mounted between the inner and the outer surface in the thickness of the casing. The casing sub comprises further an electronics package 23 mounted on the outer surface and connecting means, not shown on the drawing, between the antenna, the electronics package and the sensor. When sensor measures formation fluid properties, other additional elements, presented in the drawing of FIG. 2 can be added: a protective housing mounted on the electronics package 23, a protective carrier mounted on the sensor 24, a coupling element 25A ensuring contact between the sensitive part of the sensor and the fluids of the formation, and a pressing mean 22 mounted on the opposite side and applying enough force on the borehole wall 48 to improve close contact between the coupling element and the formation.

Alternatively, when sensor measures fluid properties in the well a coupling element 25B (not shown) can ensure contact between the sensitive part of the sensor and the fluids inside the well.

In a first embodiment of the invention the casing sub is dedicated to measure properties of the formation when wake-on by an interrogating tool located in the internal cavity 14. The interrogating tool is positioned closed to the casing sub thanks to indexing elements placed in the thickness or on the inner surface of the casing sub. The tool will activate the casing sub ensuring power supply to the functional elements and will recover measured data by the sensor. When measurements are done, the casing sub becomes inactive until the next interrogation. The wireless power supply and data communication between the casing sub and the interrogating tool is ensured via electromagnetic coupling.

The principle for interrogation of the casing sub shown in FIG. 2 is based on electromagnetic coupling between the toroidal antenna and a proximate interrogating tool 20 located in the internal cavity 14, as shown in FIGS. 3A, 3B, 3C, 3D and 3E. The same toroidal antenna is used both for communication link and for power transfer. The interrogating tool can be embodied as a wireline tool lowered into the well in the internal cavity and removed from the well by means of a wireline cable 26; or as a tool integrated on a tubing 300 and lowered permanently into the well in the internal cavity.

Figure 3A:
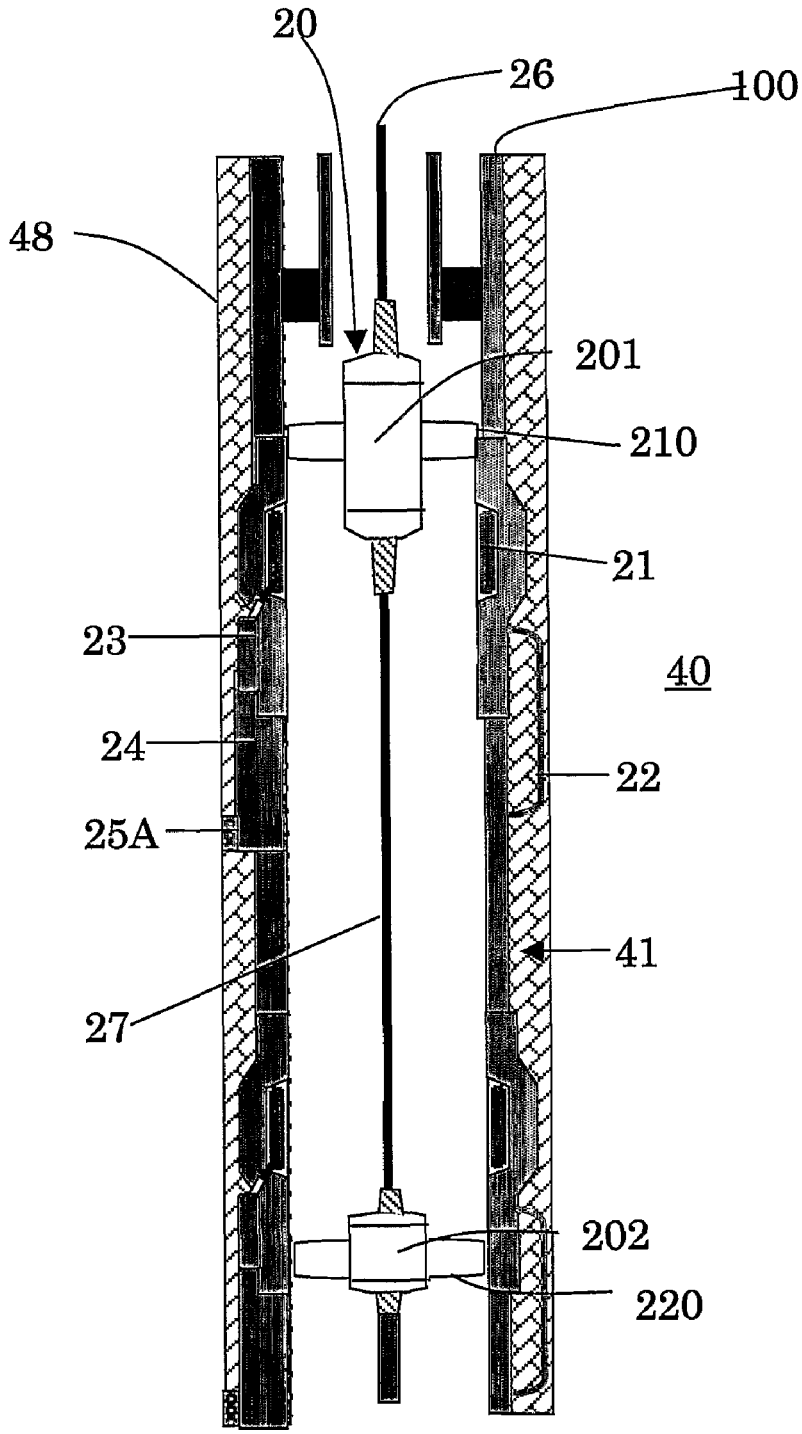
FIG. 3A shows an interrogating tool embodied as a wireline tool for deployment in the internal cavity.

In FIG. 3A, the interrogating tool is embodied as a wireline tool 20. The interrogating tool is made of an upper part 201 and a lower part 202 linked through a cable 27 containing a conductor cable 270. The upper part contains an upper electrode 210 which ensures contact with the casing 100 upstream of the toroidal antenna and the lower part contains a lower electrode 220 which also ensures contact with the casing downstream of the toroidal antenna. The conductor cable 270 is connected to the lower electrode 220 and another conductor cable 260 (not shown) is connected to the upper electrode 210. In this way, a conductive circuit flows from the conductive cable 270, to the lower electrode 220, to the casing, and returns to the upper electrode 210 and to the conductive cable 260. The conductive cables 260 and 270 can be connected to downhole equipment (not shown) in the interrogating tool, which will ensure processing and delivery of the electric signal and can be further connected to surface through the wireline cable 26. The conductive cables 260 and 270 can also be connected directly to the surface through the wireline cable 26. This design is realizable, because casing is conductive, normally made of steel. The upper electrode is a metallic bow in close contact with the inner surface of the casing with enough force to ensure electrical contact. The lower electrode is also a metallic spring bow in close contact with the inner surface of the casing with enough force to ensure electrical return. The interrogating tool 20 is presented here as an example of realization, it is believed that other subsequent modifications can be done. Also, the interrogating tool 20 can be made of one element, comprising an upper and a lower part but not linked through a cable 27.

Figure 3B:
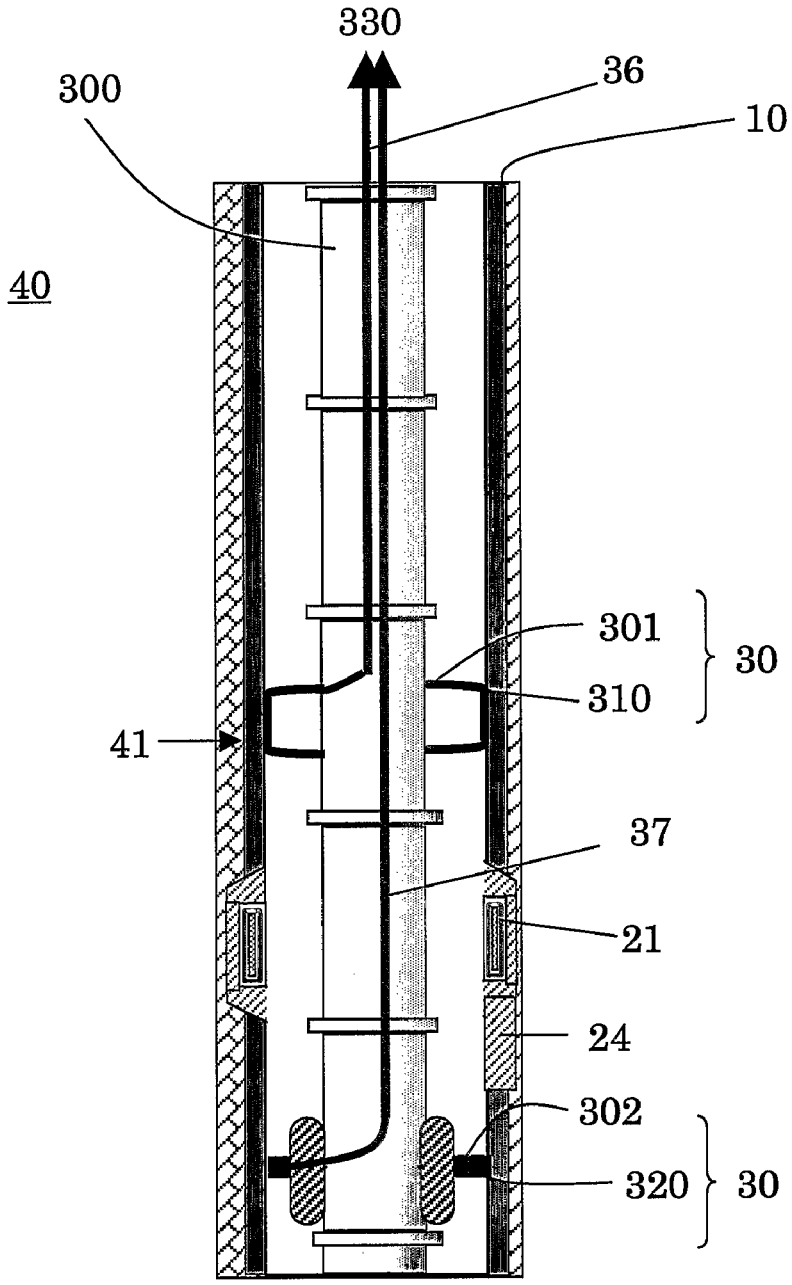
FIG. 3B shows an interrogating tool embodied as a permanent tool for deployment in the internal cavity.

In FIG. 3B, the interrogating tool is embodied as a tool 30 integrated on a production tubing 300. The interrogating tool is made of an upper part 301 and a lower part 302 linked. The upper part contains an upper electrode 310 which ensures contact with the casing 100 upstream of the toroidal antenna and the lower part contains a lower electrode 320 which also ensures contact with the casing downstream of the toroidal antenna. A conductor cable 37 is connected to the lower electrode 320 and another conductor cable 360 (not shown) is connected to the upper electrode 310. In this way, a conductive circuit flows from the conductive cable 37, to the lower electrode 320, to the casing, and returns to the upper electrode 310 and to the conductive cable 360. The conductive cables 37 and 360 can be connected to downhole equipment (not shown) in the interrogating tool, which will ensure processing and delivery of the electric signal and can be further connected to surface equipment 330 through a cable 36. The conductive cables 360 and 37 can also be connected directly to the surface equipment 330 through the cable 36. The conductive cables 37, 36 and 360 are coated with an insulated jacket to avoid any current leakage through the tubing. The elements 301-310 or 302-320 can be embodied in other elements used in the well, such as packers for example, important is as in FIG. 3A to ensure electrical contact and return through the casing. It is also possible to use the tubing 300 as conductive cable to connect the upper electrode 310 and lower electrode 320 of the interrogating tool, this tubing being coated with an insulated jacket to avoid any current leakage.

Figure 3C:
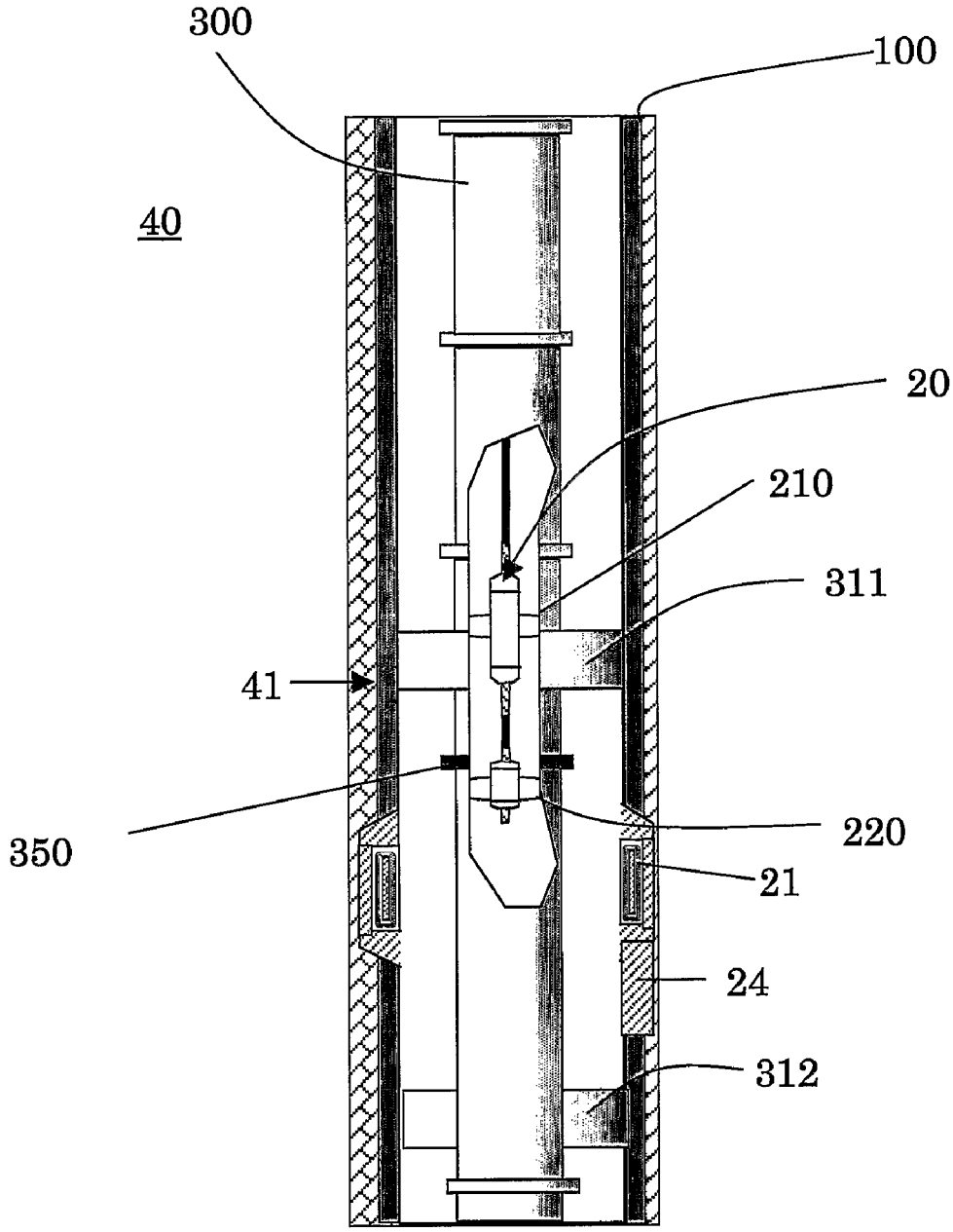
FIGS. 3C and 3D shows an interrogating tool embodied as a wireline tool for deployment in the internal cavity of a production tubing with modified design.

In FIG. 3C, the interrogating tool is embodied as a wireline tool 20 as disclosed in FIG. 3A. The same embodiments apply to this wireline tool 20. This time, the principle for interrogation of the casing sub shown in FIG. 2 can be realized thanks to the architecture of the well as it will be disclosed. The well comprises a production tubing 300 and a casing 100 which are linked through an upper part 311 and a lower part 312. The upper part 311 ensures contact with the casing 100 upstream of the toroidal antenna and the lower part 312 ensures contact with the casing downstream of the toroidal antenna. As known, the casing and the production tubing are conductive, normally made of steel. If a conductive loop can be realized to interrogate the casing sub, insulation has to be added to the production tubing: this is realized thanks to insulated gap 350 which is located downstream or upstream of the toroidal antenna, but between the upper part 311 and the lower part 312 (In FIG. 3C the insulated gap is located upstream of the toroidal antenna). The design of the insulated gap will be explained after. The interrogating tool is lowered into the well in the internal cavity of the production tubing and is made of an upper part 201 and a lower part 202. The upper part 201 contains an upper electrode 210 which ensure contact with the production tubing upstream of the insulated gap 350 and the lower part 202 contains a lower electrode 220 which also ensures contact with the production tubing downstream of the insulated gap 350. The upper electrode is a metallic bow in close contact with the inner surface of the production tubing with enough force to ensure electrical contact. The lower electrode is also a metallic spring bow in close contact with the inner surface of the production tubing with enough force to ensure electrical return. The upper part 311 and lower part 312 realize the electrical contact between casing and production tubing, it can be for example shorting centralizers or any conductive links. The distance between the shorting centralizers depends on several factors, such as the power provided by the wireline tool, the power requirement of the sensor electronics, and the conductivity of the fluid between the production tubing and the casing. In many cases, it may be possible to separate the shorting centralizers from about ten meters. In case of highly conductive fluids into the annular region, the production tubing can be coated with an electrically insulating deposit such as epoxy. This coating will significantly reduce the electrical losses into conductive annular fluids. In case of large spacing between shorting centralizers, intermediate and insulating centralizers might have to be added along the tubing to avoid electrical contact with the casing due to tubing flexion or bending. Such contacts would alter the communication and power transfer. Rubber types insulating centralizers can be used.

Figure 3D:
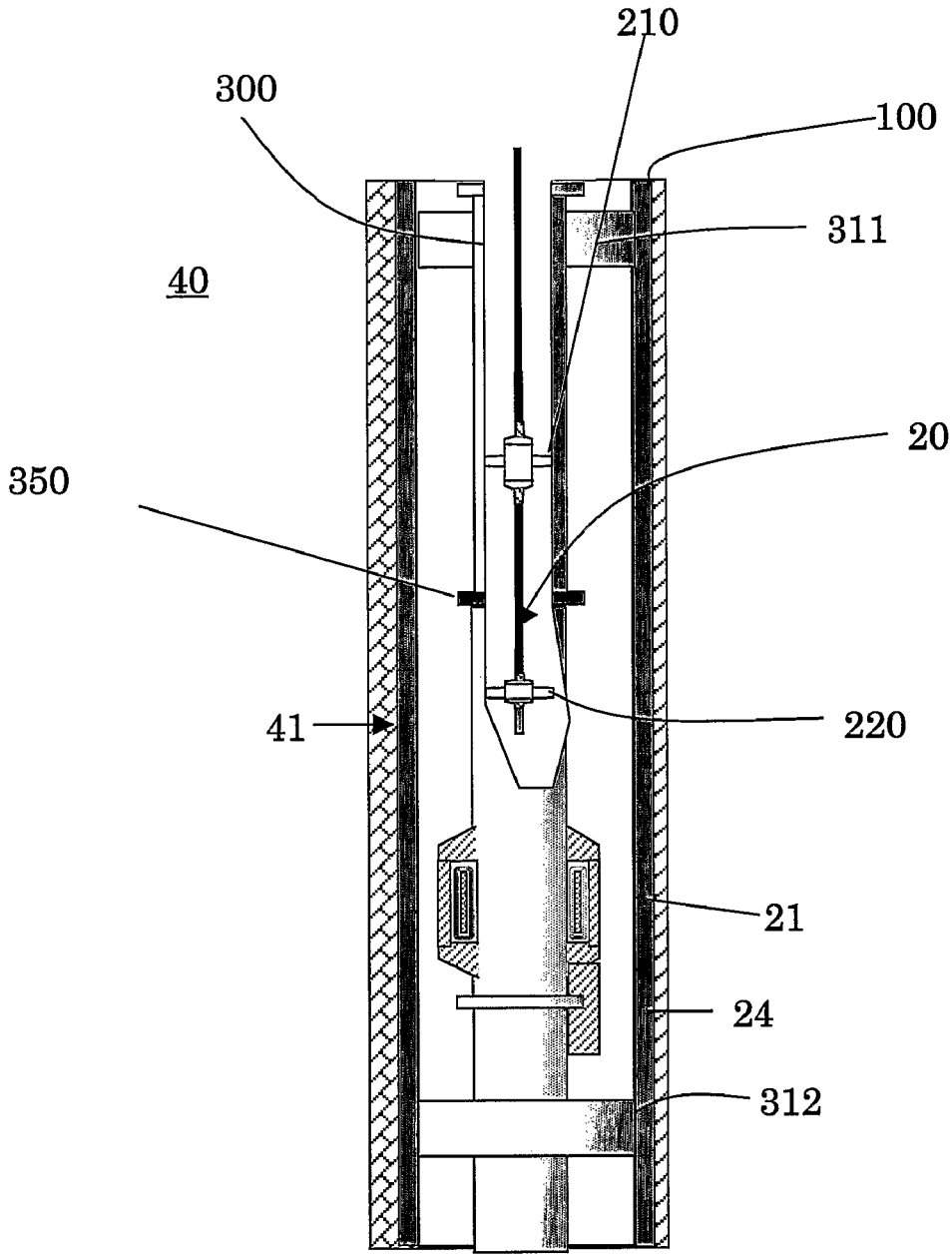

FIG. 3D is another alternative to FIG. 3C in the case where the monitoring system is a tubing sub instead of a casing sub. In FIG. 3D, the interrogating tool is embodied as a wireline tool 20 as disclosed in FIG. 3A. The same embodiment applies to this wireline tool 20. The principle for interrogation of the tubing sub shown in FIG. 2 will be the same. The insulated gab will be also used to avoid short circuit. The insulated gap 350 is located downstream or upstream of the toroidal antenna, but between the upper part 311 and the lower part 312 (In FIG. 3D the insulated gap is located upstream of the toroidal antenna). In same way, the upper part 311 ensures contact with the casing 100 upstream of the toroidal antenna and the lower part 312 ensures contact with the casing downstream of the toroidal antenna. For the insulated gap located upstream of the toroidal antenna, the upper electrode 210 ensures contact with the production tubing upstream of the insulated gap and the lower electrode 220 ensures contact with the production tubing downstream of the insulated gap and upstream of the toroidal antenna. And for the insulated gap located downstream of the toroidal antenna, the upper electrode 210 ensures contact with the production tubing upstream of the insulated gap and downstream of the toroidal antenna and the lower electrode 220 ensures contact with the production tubing downstream of the insulated gap.

Figure 3E:
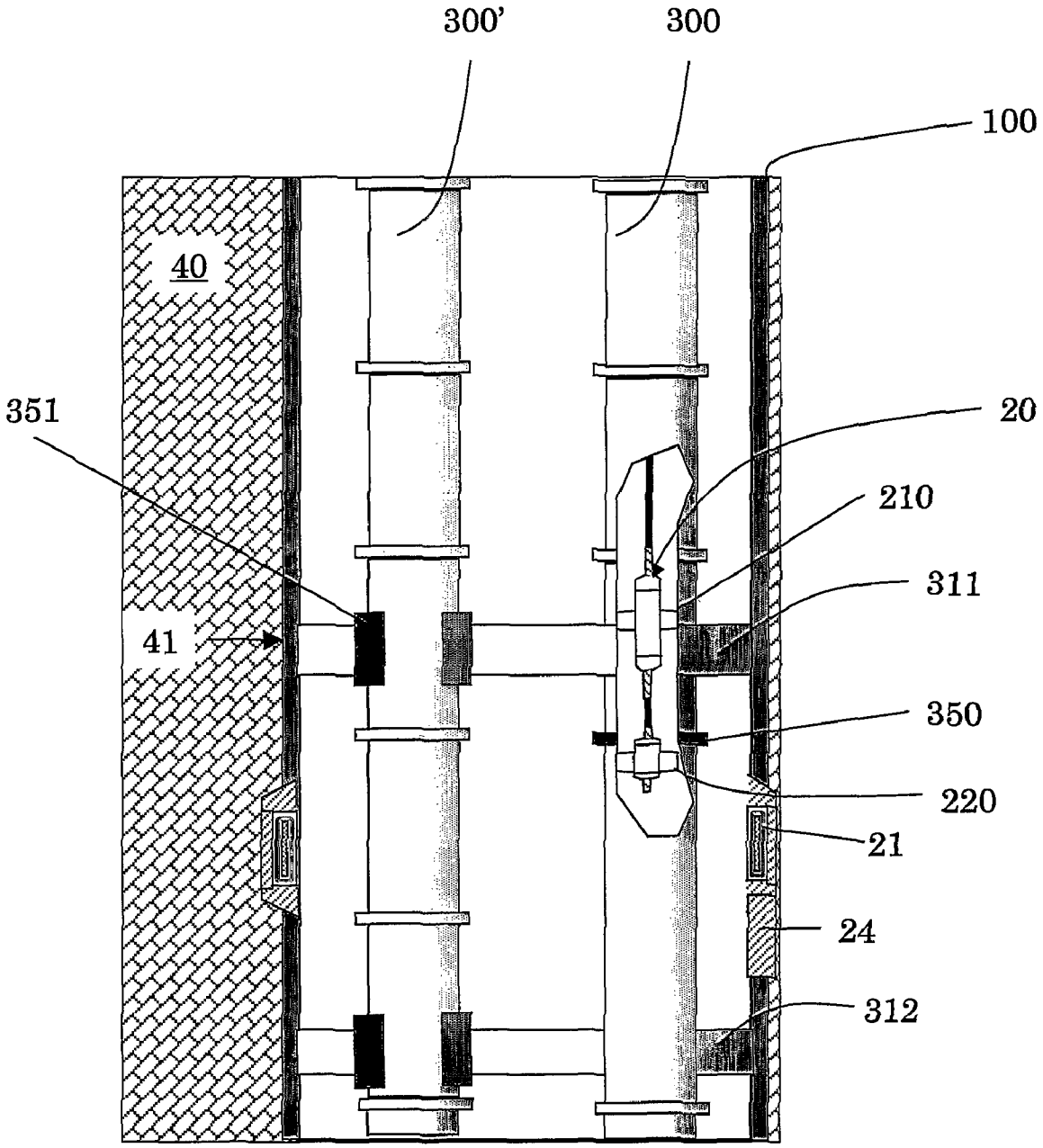
FIG. 3E shows an interrogating tool embodied as a wireline tool for deployment in the internal cavity of a production tubing of a multiple production tubing well.

In FIG. 3E, the interrogating tool is embodied as a wireline tool 20 as also disclosed in FIG. 3A. The same embodiments apply to this wireline tool 20 and the same interrogating method as disclosed for FIG. 3C applies. When multiple tubing strings are required to produce different zones, the system can still be used. The well comprises two production tubing (300, 300') and a casing 100 which are linked through an upper part 311 and a lower part 312. The upper part 311 ensures contact with the casing 100 upstream of the toroidal antenna and the lower part 312 ensures contact with the casing downstream of the toroidal antenna. The production tubing 300' is insulated from the upper part 311 and the lower part 312 thanks to insulator 351. The insulator 351 is made of an insulating tubes e.g. fiberglass-epoxy or of rubber layers. Otherwise, the principle for interrogation of the casing sub shown in FIG. 2 will be the same.

Figure 9:
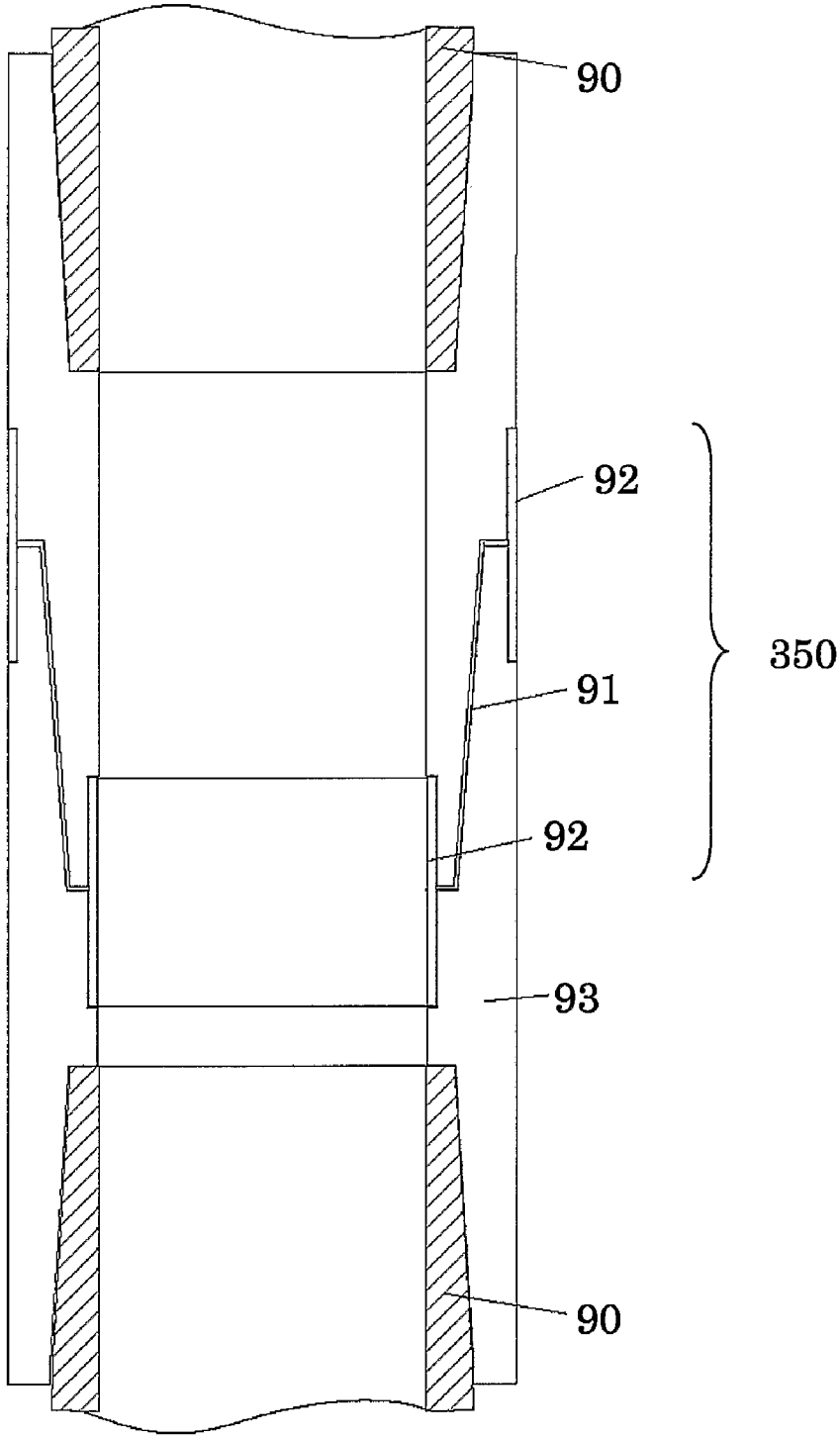
FIG. 9 shows a view of the insulated gap on a production tubing.

FIG. 9 shows an insulated gap 350 in a common size of production tubing 90 (2⅞ inches OD)—(7.3 cm). A standard non-upset collar 93 is mounted on the production tubing. The standard non-upset collar 93 for this production tubing is 3.50 inches (8.9 cm) in diameter and provides sufficient wall thickness to implement an insulated gap using a ceramic coated pin 91. Thin insulating tubes 92 (e.g. fiberglass-epoxy) can be used to provide mechanical protection and additional insulation. Rubber layers 92 can also be used to improve the electrical insulation by preventing water incursion into the insulating gap.

Figure 4A:
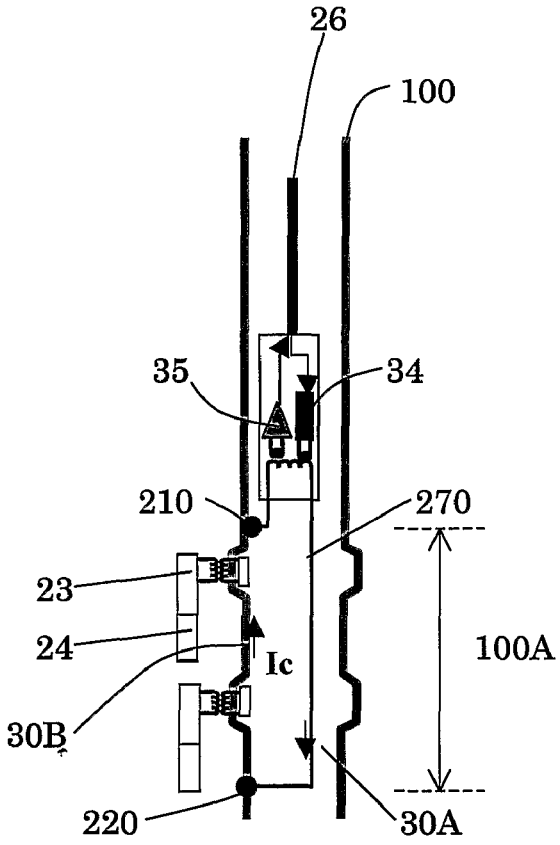
FIG. 4A shows the principle for communication with the interrogating tool integrated on a producing tubing.
Figure 4B:
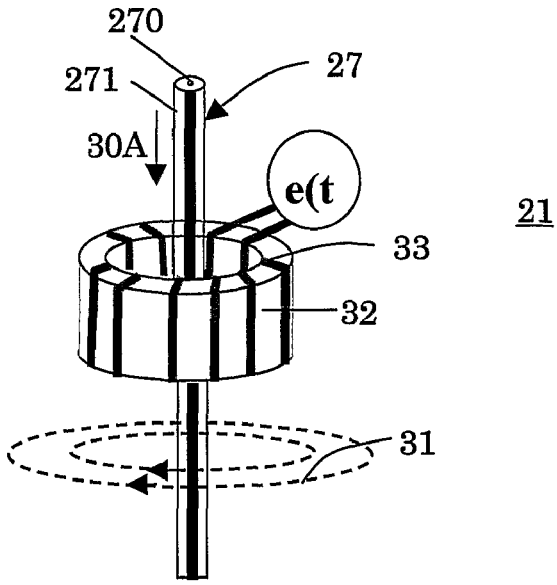
FIG. 4B shows the principle for a toroidal antenna.

FIGS. 4A and 4B illustrate the schematic principle of this power and signal transmission. References are used for the interrogating tool described in FIG. 3A, nevertheless the concept is the same for the interrogating tool described in FIG. 3B. Current Ic is injected into a casing segment 100A via the interrogating tool 20 through two contact electrodes. Current flows along illustrative current lines 30A from the upper part of the tool through a conductor cable 270 to the lower part of the tool. The current is then injected into the casing segment 100A through the lower electrode 220. The injected current will flow along illustrative current lines 30B through casing segment 100A and will return to the tool through the upper electrode 210. The circuit loop so created must contain at least one toroidal antenna in the casing segment defined (in FIG. 4B the circuit loop contains two toroidal antennae). The toroidal antenna is made of a ring 32 of magnetic material and a toroidal coil wire 33 connected to the electronics package. The toroidal antenna is embedded in a non-conductive material such as epoxy for electrical insulating, and put in a cavity on the inner surface of the casing. The aforementioned injected current flowing through the conductor cable 270 inductively generates a magnetic field 31, which is maintained in the magnetic ring. This magnetic field generates then in the toroidal coil wire an electrical signal delivered to the functional elements.

Various signals including power and data communication can be modulated through this toroidal antenna. For this aim, the electronics package 23 contains a signal processing unit and a power supply recovery/delivery unit. The interrogating tool receives through the wireline cable 26, direct current and a DC/AC converter stage 34 located on the upper part of the tool provides the alternative current Ic needed for power transfer and generated in conductor cable 270. This alternative current of low frequency generates also an AC voltage in the toroidal coil wire. The required DC voltage for functional elements powering is then provided via a rectifier circuit present in the power supply recovery/delivery unit. Reciprocally, for data communication signals, the signal sensed by the sensor is encoded via the signal processing unit into a second AC voltage in the toroidal antenna by an encoder circuit, at a different bandwidth than the AC power transfer. This second voltage creates a second current, which will follow the same pathway as the injected current through the casing segment 100A and the conductor cable 270. This second alternative current is then amplified by an amplification stage 35 on the interrogating tool and processed and stored in an additional element of the interrogating tool or sent up to surface through the wireline cable. The conductor cable 270 is coated with an insulated jacket 271 to avoid any current leakage. No external metallic shield is allowed as that can short-circuit the upper and lower electrodes. Preferably, the fluid in the internal cavity is non-conductive to minimize current leak between the two electrodes. However, even in case of conductive brine, the overall fluid column resistance between the two electrodes will be far over the casing segment so that the current will return via the casing. Therefore, the power and data communication transfer will work even in conductive brine but with less efficiency than in a non-conductive annular fluid.

In a second embodiment of the invention the casing sub is dedicated to measure properties of the formation in a more autonomous way and integrates functionalities in order to perform dedicated tasks such as data acquisition, internal data saving and communication with the wireline tool 20 lowered into the well. A programmable micro-controller, that will schedule the electronics tasks and control the acquisition and data transmission, can be added and can be reprogrammed if required by the interrogating tool. For this aim, the electronics package 23 will contain a signal processing unit, a power supply recovery/delivery unit, a wireless transmission/reception communication unit, a micro-controller/storage unit and a power storage unit. The interrogating tool is positioned closed to the casing sub thanks to indexing elements placed in the thickness or on the inner surface of the casing sub. At request made by the tool, the data emission is initiated and the stored data are sent to the wireless transmission/reception communication unit. When loading of data by the tool is done, the interrogating tool is lowered to another location and the casing sub will measure the properties of the formation with defined schedule and store them until the next interrogation. If required, the tool can reprogram the micro-controller of the casing sub to perform other tasks or with another schedule. In this embodiment, wireless data communication between the casing sub and the interrogating tool is ensured via electromagnetic coupling as described above. The power supply of the casing sub is only ensured via an integrated battery for all the life of the well.

In a third embodiment of the invention the casing sub is dedicated to measure properties of the formation and further comprises a rechargeable battery. The interrogating tool ensures a wireless power transfer to recharge the battery and a wireless data communication to unload stored data and additionally to reprogram the micro-controller. The wireless power supply and data communication between the casing sub and the interrogating tool is ensured via electromagnetic coupling as described above.

The wireless power transfer for direct or indirect power supply of the functional elements is allowed thanks to the use of low or very-low power electronics inside the casing sub so that the requirements in term of electrical consumption will be extremely small.

In the embodiments here described, the wireless data and power communication is ensured via electromagnetic coupling, although basic concepts of the invention can be implemented with other alternate technique for wireless communication. The wireless communication between the casing sub and the interrogating tool can be ensured via microwave or optical beam transfer. The wireless data communication can be further ensured via acoustic coupling. Especially, the optical method could find application in water wells due to weak light attenuation in such fluid.

In FIGS. 1 and 2 the sensor is mounted on the outer surface of the casing or tubing sub. Nevertheless, the sensor can also be mounted on the inner surface of the casing or tubing sub. Various types of sensors and technology can be implemented in the casing sub. Sensors can measure properties from the formation or alternatively properties from the well infrastructure as casing or tubing, or even alternatively properties from fluid inside the well; combination of several sensors measuring various properties is also possible. Such sensors can, for example, measure the fluid pressure or velocity inside the well or measure the surrounding formation fluid pressure, resistivity, salinity or detect the presence of chemical components such as $CO_2$ or $H_2S$, the sensors can also be applied to measure casing or tubing properties such as corrosion, strain and stress. As example, the following types of sensors can be implemented:

Pressure and temperature,
Resistivity (or conductivity),
Casing and Tubing stress or strain,
pH of surrounding fluids,
Chemical content such as $CO_2$ and $H_2S$ monitoring.

Systems according to the invention can be used to monitor formation or well properties in various domains, such as:

Oil and Gas Exploration and Production,
Water storage,
Gas Storage,
Waste underground disposal (chemicals and nuclear).

As opposed to previous technique for permanent monitoring there is no cable outside the completion element such as the well casing or tubing. When deploying an array of casing sub with sensor, the presence of cable outside casing might create a channel in the cement. If this occurs, this channel will create cross-flow between the sensors array leading to a misleading tests analysis. Having no cable outside casing will avoid this misleading event. Besides, in term of completion, having no cable to clamp to the surface means that the well construction can be performed according to standard procedure, with no extra rig-time. Casing reciprocating and rotation will also be feasible, which is often a required operation to achieve a good cement job. This can be of high importance to achieve effective pressure insulation between the different reservoir layers.

Figure 5:
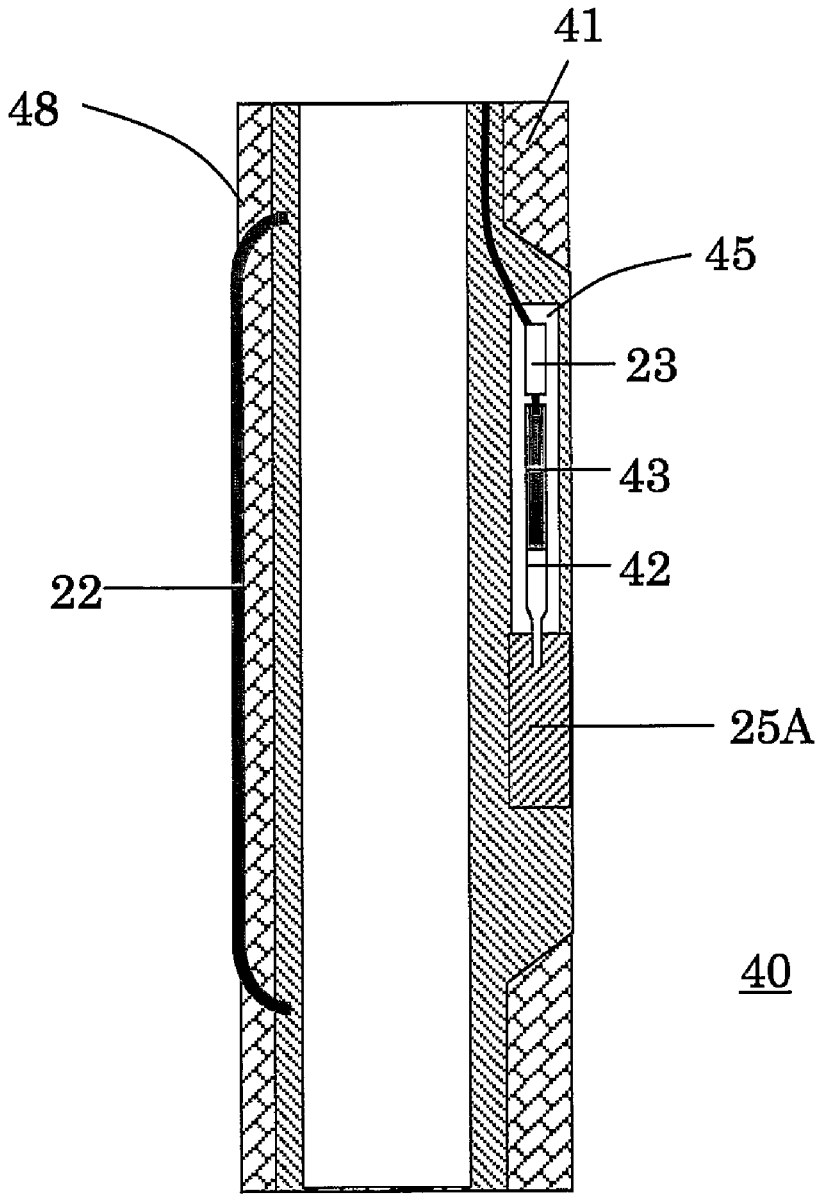
FIG. 5 shows a formation pore pressure measurement casing sub in longitudinal view.
Figure 6:
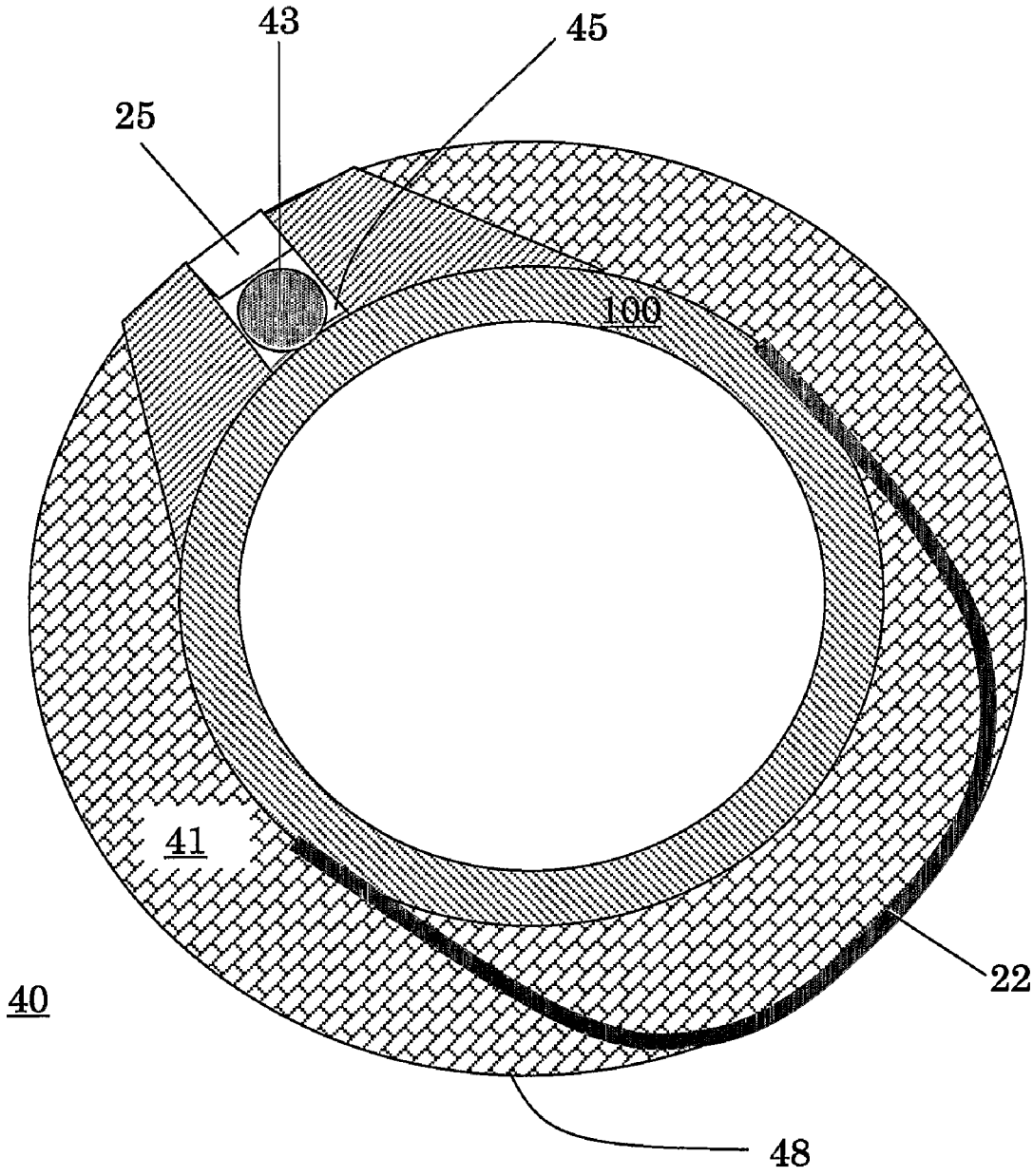
FIG. 6 shows a formation pore pressure measurement casing sub in cross view.

In a preferred embodiment the casing sub is dedicated to a formation pore pressure measurement shown in FIGS. 5 and 6. The casing sub has an enlarged section forming a carrier in which a chamber 45 is defined. A pressure gauge 43 is located inside the chamber and is connected to an electronics package 23 and to a buffer tube 42, which is filled with a relatively incompressible liquid. Since cement is usually impermeable, it is necessary to provide means of fluid communication between the sensor and the formation in order that pressure can be measured. Therefore the casing sub comprises a coupling element 25 insuring communication between the liquid of the buffer tube and the fluids of the formation, and a spring bow 22 mounted on the opposite side and applying enough force on the borehole wall 48 to improve close contact between the coupling element and the formation.

Different coupling elements can be used additionally with the spring bow 22 or independently. In a preferred embodiment, coupling element is a chamber filled with a material selected for it high permeability in order to transmit the hydraulic pressure from the surrounding fluids to the pressure gauge. Also, the pore size distribution of the material pore is made small enough so that the cement particles will not penetrate inside the material. For example, a high permeable resin or permeable cement can be used as such material. Before installing the casing sub in the well, the high material or resin is preliminary saturated with a clean fluid such as water or oil, to minimize any fluids entry when the casing sub is positioned in the well. Additionally, before the cement job, a fluid spacer will be circulated to clean the hole and remove the mud cake, as much as possible. A mud-cake scratching device can also be placed by design close to the pressure gauge to remove the mud-cake by reciprocating.

Other coupling means described in patent GB 2366578 are discussed here below. The coupling element can be an integrated device releasing a substance that prevents curing during the setting of the cement; or that increases the permeability of the cement during the setting of the cement; or that changes the coefficient of expansion of the cement during curing. The coupling element can also be an integrated device creating shear waves that induce cracks in the cement during curing.

In the first case, a cement curing retarder is introduced into the cement slurry in the region of the sensor totally to prevent curing of the cement in that region. In use, the region of uncured cement then provides fluid communication. Examples of suitable retarders include substances the molecules of which contain a substantial number of —OH groups and high temperature retarders from the family of organophosphate chelating agents.

In the second case, a system is used to increase the permeability of the cement in the region of the sensor, typically by the introduction of gas bubbles into the cement before it has set. A suitable system for inducing gas bubbles is a small gas container releasing gas by opening a valve, by triggering a small explosive charge, or by chemical reaction if the gas is stored in the container in liquid or solid state. A preferred gas is carbon dioxide, which will slowly react with the cement, leaving interstices in the cement, which will become occupied by water, oil or other liquid.

In the third case, a method is used to change the coefficient of expansion of the cement and to induce cracks in the cement during curing. This goal is achieved by releasing a substance, such as magnesium or aluminum salts, of metal bristles in the cement before curing.

In the last case, a sonic, solenoid or piezoelectric device creates shear waves in the cement that induce cracks in the cement during curing.

Figure 7:
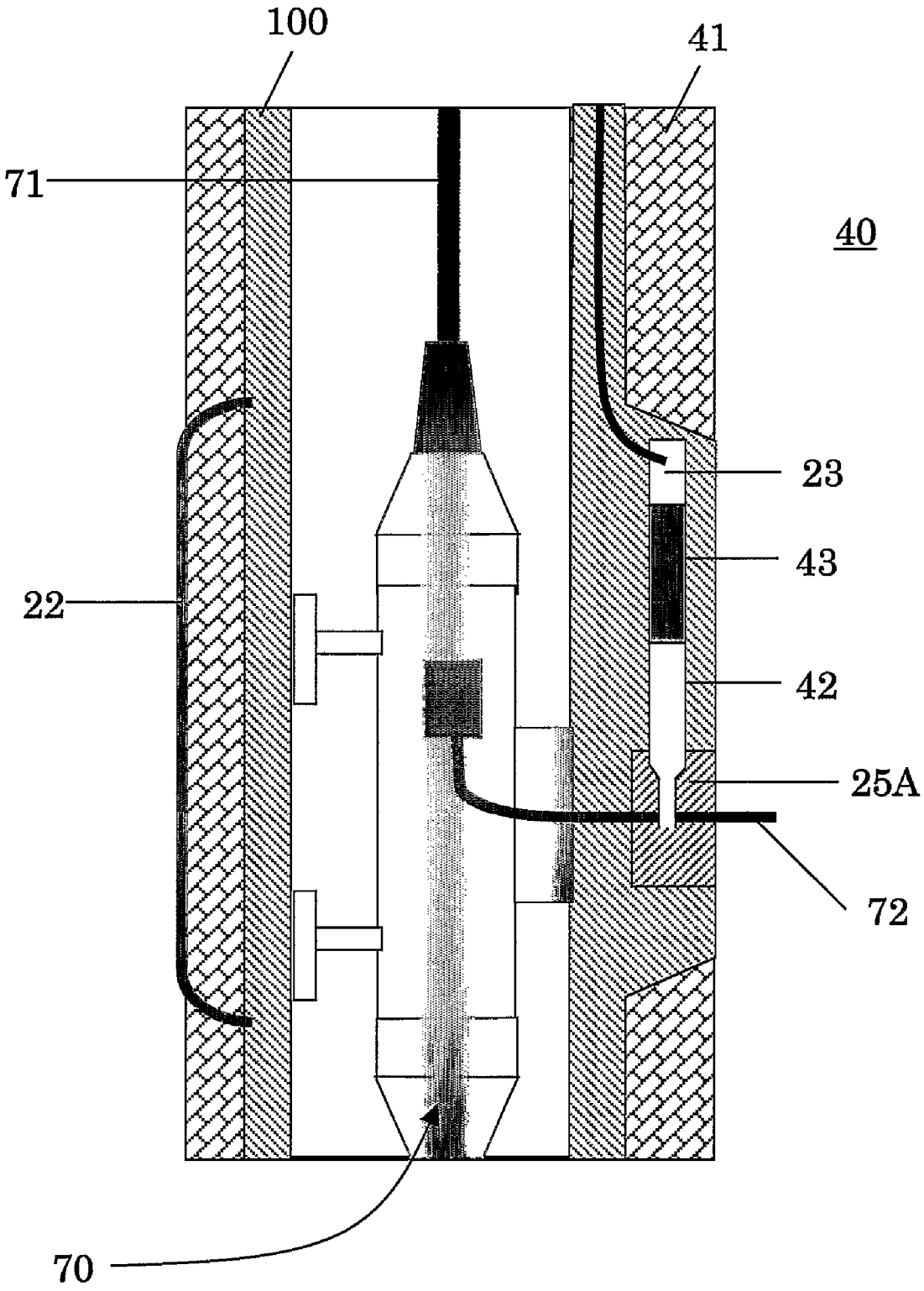
FIG. 7 shows a schematic view of a drilling operation to connect a sensor to the formation fluid.
Figure 8:
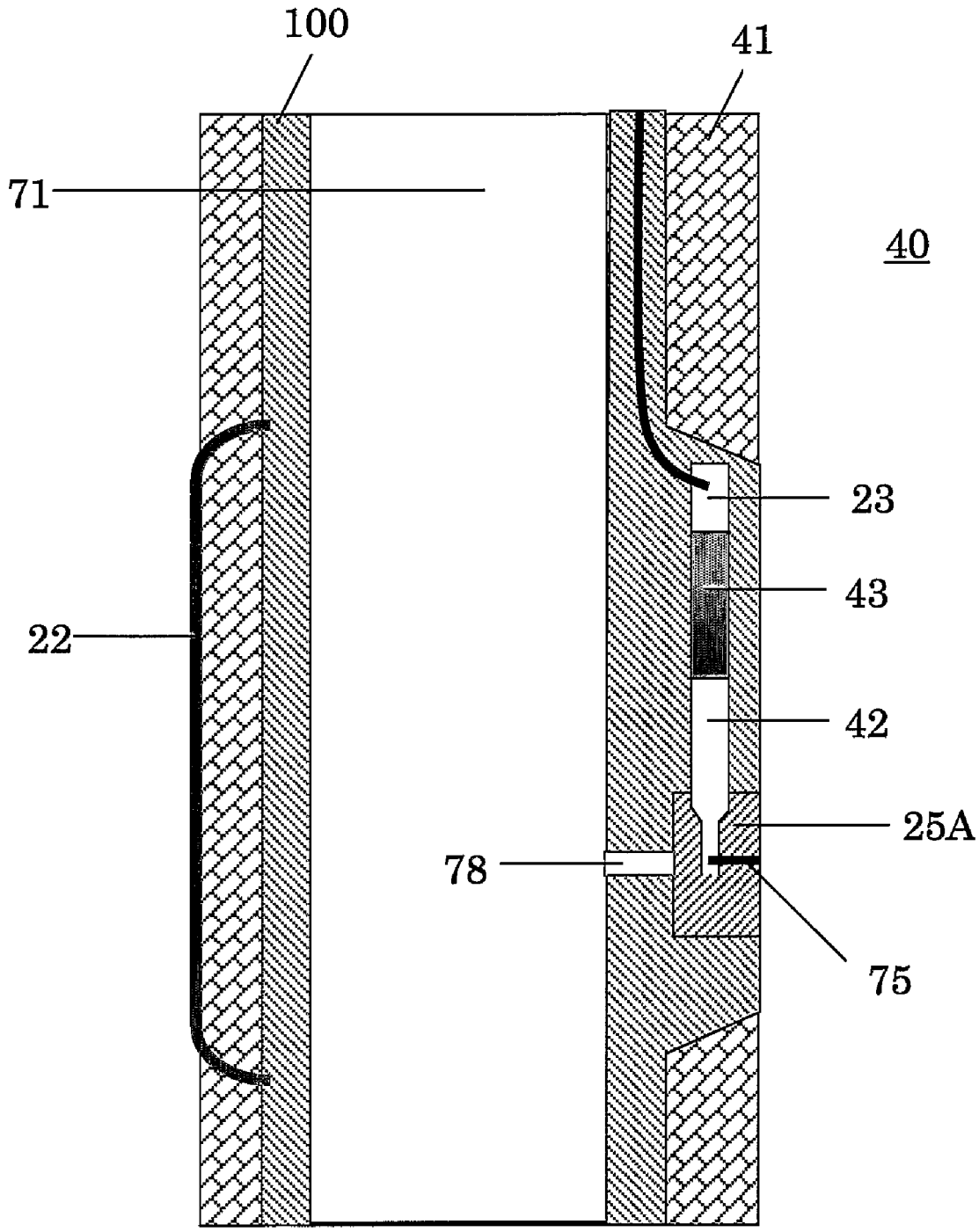
FIG. 8 shows a view of the casing sub with the hole plugged after drilling.

Another way to provide fluid communication between the sensor and the reservoir is described in patent WO 03 100218, this method uses a micro-drilling technique based on the use of a drilling tool such as a CHDT tool (Mark of Schlumberger). After installation of the casing sub carrying sensors into the well, fluid communication between sensor and the reservoir is ensured by the steps of: positioning a drilling tool 70, lowered into the well through a wireline cable 71 inside the casing, adjacent to the coupling element 25 (FIG. 7-8); drilling with a drilling shaft 72 through the casing 100, carrier and coupling element 25A and cement 41 into the formation 40 surrounding the well so as to create a fluid communication path 75 between the sensor and the reservoir; and finally sealing the hole drilled in the casing by the drilling tool with a sealing plug 78.

Figure 3F:
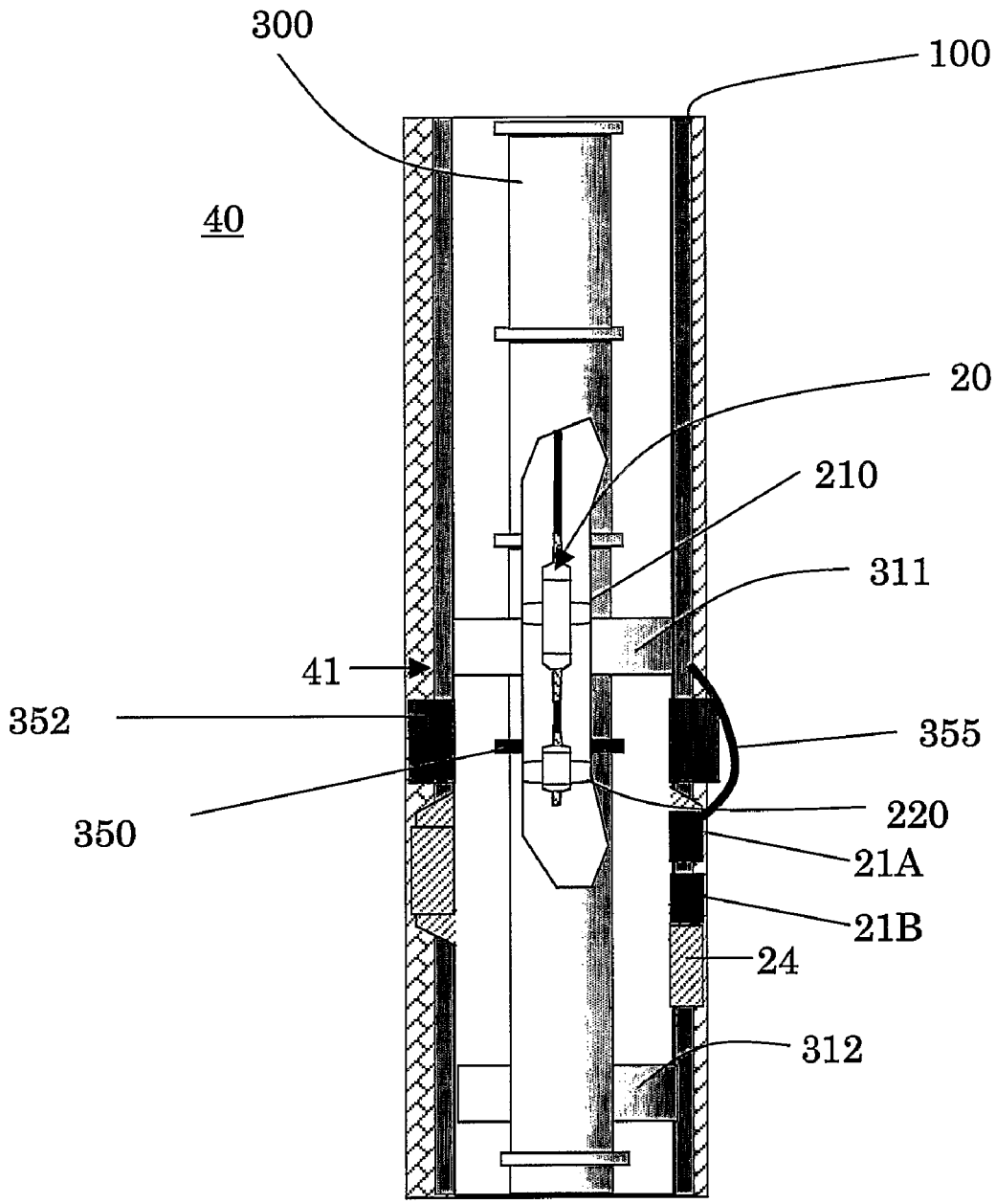
FIG. 3F shows an interrogating tool embodied as a wireline tool for deployment in the internal cavity of a casing sub according to a further aspect of the invention.

FIG. 3F is another embodiment of the casing or tubing sub. The principle for interrogation of the casing sub of FIG. 3F is based on electric transfer between data and power communication means and a proximate interrogating tool 20 located in the internal cavity 14. The well comprises a production tubing 300 and a casing 100 which are linked through an upper part 311 and a lower part 312. The well comprises also two insulated gaps as disclosed above. One insulated gap 352 is located on the casing 100. The upper part 311 ensures contact with the casing 100 upstream of the insulated gap 352 and the lower part 312 ensures contact with the casing downstream of the insulated gap 352. The other insulated gap 350 is located on the production tubing 300 between the upper part 311 and the lower part 312.

The interrogating tool 20 is embodied as a wireline tool 20. The interrogating tool is made of an upper part 201 and a lower part 202 linked through a cable 27 containing a conductor cable 270. The upper part contains an upper electrode 210 which ensures contact with the tubing 300 upstream of the insulated gap 350 and the lower part contains a lower electrode 220 which also ensures contact with the tubing downstream of the insulated gap 350. The conductor cable 270 is connected to the lower electrode 220 and another conductor cable 260 (not shown) is connected to the upper electrode 210. This design is realizable, because casing and tubing are conductive, normally made of steel. The upper electrode 210 is a metallic bow in close contact with the inner surface of the tubing with enough force to ensure electrical contact. The lower electrode 220 is also a metallic spring bow in close contact with the inner surface of the tubing with enough force to ensure electrical return. The interrogating tool 20 is presented here as an example of realization, it is believed that other subsequent modifications can be done. Also, the interrogating tool 20 can be made of one element, comprising an upper and a lower part but not linked through a cable 27.

The upper part 311 and lower part 312 realize the electrical contact between casing and production tubing, it can be for example shorting centralizers or any conductive links. The distance between the shorting centralizers depends on several factors, such as the power provided by the wireline tool, the power requirement of the sensor electronics, and the conductivity of the fluid between the production tubing and the casing. In many cases, it may be possible to separate the shorting centralizers from about ten meters. In case of highly conductive fluids into the annular, the production tubing can be coated with an electrically insulating deposit such as epoxy. This coating will significantly reduce the electrical losses into conductive annular fluids. In case of large spacing between shorting centralizers, intermediate and insulating centralizers might have to be added along the tubing to avoid electrical contact with the casing due to tubing flexion or bending. Such contacts would alter the communication and power transfer. Rubber types insulating centralizers can be used.

The casing sub according to embodiment of FIG. 3F can be located upstream or downstream of the insulated gap 352. In FIG. 3F, the casing sub is located downstream of the insulated gap 352. The data and power communication means from the casing sub have one contact upstream of the insulated gap 350 through a conductive cable 355 and one contact directly to the casing sub. The conductive cable 355 is coated with an insulated jacket to avoid any current leakage through the casing sub. In this way a simpler conductive circuit can be realized between the casing sub and the interrogating tool without using electromagnetic transfer but easy electrical transfer. The conductive circuit flows from the conductive cable 270, to the lower electrode 220, to the tubing 300, to the lower part 312, to the casing 100, to the casing sub 10, and to the data and power communication means. After the conductive circuit returns from the data and power communication means, to the conductive cable 355, to the casing 100, to the upper part 311, to the tubing 300, to the upper electrode 310 and to the conductive cable 260. When current flows through the casing and tubing there is no short-circuit with the return current because the insulated gap 350 is present on the tubing and the insulated gap 352 is present on the casing. The conductive cables 260 and 270 can be connected to downhole equipment (not shown) in the interrogating tool, which will ensure processing and delivery of the electric signal and can be further connected to surface through the wireline cable 26. The conductive cables 260 and 270 can also be connected directly to the surface through the wireline cable 26. This new embodiment of casing sub is presented here as an example of realization, it is believed that other subsequent modifications can be done: as for example a tubing sub, or other modifications as disclosed in FIGS. 3B to 3E.

The invention claimed is:

1. A monitoring system integrated on a casing or tubing sub, having an inner and an outer surface and defining an internal cavity, comprising:

a sensor;

data communication means for providing wireless communication between an interrogating tool located in the internal cavity and the sensor, said data communication means being located on the casing or tubing sub;

power communication means for providing wireless power supply to the sensor, said power communication means being located on the casing or tubing sub; and coupling means for providing fluid communication between the sensor and fluids of the formation with a tool that can be moved through the well to a number of locations.

2. The system of claim 1, wherein the data communication means is located on the inner or outer surface of the casing or tubing sub.

3. The system of claim 1, wherein the power communication means is located on the inner or outer surface of the casing or tubing sub.

4. The system of claim 1, wherein the data communication means is inserted between the inner and the outer surface.

5. The system of claim 1, wherein the power communication means is inserted between the inner and the outer surface.

6. The system as claimed in claim 1, wherein the sensor is mounted on the outer surface.

7. The system as claimed in claim 1, wherein the data communication means are also power communication means.

8. The system as claimed in claim 1, wherein the data communication mean is a toroidal antenna.

9. The system as claimed in claim 1, further comprising an electronics package including:

a signal processing unit; and a power recovery/delivery unit.

10. The electronics package of claim 9, further comprising:

a wireless transmission and reception communication unit, a micro-controller and memory unit, and a power storage unit.

11. The electronics package as claimed in claim 10, wherein the power storage unit is a rechargeable battery.

12. The system as claimed in claim 1, further comprising pressing means for ensuring contact between the coupling means and the formation.

13. The system as claimed in claim 1, further comprising coupling means for providing fluid communication between the sensor and fluids inside the well.

14. A method of completing a well in a subsurface formation comprising the installation of a tubing having an upper part and a lowerpart, said tubing containing at least one system according to claim 1.

15. The method of claim 14, further comprising the step of insulating a part of the tubing with an insulated gap which insulates electrically the upper part of the tubing from the lower part of the tubing.

16. The method of claim 15, wherein the step of insulating is realized with a ceramic coated pin located between the upper part of the tubing and the lower part of the tubing.

17. The method of claim 14, further comprising the step of insulating a part of the casing with an insulated gap which insulates electrically the upper part of the casing from the lower part of the casing.

18. The method of claim 17, wherein the step of insulating is realized with a ceramic coated pin located between the upper part of the casing and the lower part of the casing.

19. A method of monitoring subsurface formations containing at least one fluid reservoir and traversed by at least one well equipped with a casing or tubing sub according to claim 1, the sensor measuring a parameter related to the formation fluids and comprising the step of establishing a wireless signal communication between the sensor and the interrogating tool, wherein signal is of data or power type.

20. A method of monitoring at least one fluid inside a well, said well being equipped with a casing or tubing sub according to claim 1, the sensor measuring a parameter related to the fluid and comprising the step of establishing a wireless signal communication between the sensor and the interrogating tool, wherein signal is of data or power type.

21. The method of claim 19 or 20, further comprising step of inferring formation properties from the time varying measurements.

22. A method of monitoring subsurface formations containing at least one fluid reservoir and traversed by at least one well equipped with a casing or tubing sub according to claim 1, wherein the sensor measures a parameter related to the formation fluids; said method:

monitoring variation in the measurements made by the sensor over time with the interrogating tool located in the internal cavity, said interrogating tool delivering power supply and unloading the measurements to the surface; and inferring formation properties from the time varying measurements.

23. A method of monitoring subsurface formations containing at least one fluid reservoir and traversed by at least one well equipped with a casing or tubing sub according to claim 1, wherein the sensor measures a parameter related to the formation fluids; said method:

monitoring variation in the measurements made by the sensor over time;

loading the measurements to the surface with the interrogating tool located in the internal cavity and inferring formation properties from the time varying measurements.

24. A method of monitoring at least one fluid inside a well, said well being equipped with a casing or tubing sub according to claim 1, wherein the sensor measures a parameter related to the fluid; said method:

monitoring variation in the measurements made by the sensor over time with the interrogating tool located in the internal cavity, said interrogating tool delivering power supply and unloading the measurements to the surface; and inferring formation properties from the time varying measurements.

25. A method of monitoring at least one fluid inside a well, said well being equipped with a casing or tubing sub according to claim 1, wherein the sensor measures a parameter related to the fluid; said method:

monitoring variation in the measurements made by the sensor over time;

loading the measurements to the surface with the interrogating tool located in the internal cavity and inferring formation properties from the time varying measurements.

26. A method of monitoring casing or tubing inside a well, said well being equipped with a casing or tubing sub according to claim 1, wherein the sensor measures a parameter related to the casing or tubing properties; said method:

monitoring variation in the measurements made by the sensor over time with the interrogating tool located in the internal cavity, said interrogating tool delivering power supply and unloading the measurements to the surface; and inferring formation properties from the time varying measurements.

27. A method of monitoring casing or tubing inside a well, said well being equipped with a casing or tubing sub according to claim 1, wherein the sensor measures a parameter related to the casing or tubing properties; said method:

monitoring variation in the measurements made by the sensor over time;

loading the measurements to the surface with the interrogating tool located in the internal cavity and inferring formation properties from the time varying measurements.

28. The method of claim 22, further comprising the step of recharging the battery.

29. The method according to claim 22, further comprising the step of reprogramming the micro-controller.

30. A method of completing a well in a subsurface formation comprising:

providing a completions system including a data communication means for providing wireless communication between an interrogating tool located in the internal cavity and the sensor, said data communication means being located on the casing or tubing sub, and a power communication means for providing wireless power supply to the sensor, said power communication means being located on the casing or tubing sub;

installing a casing containing at least one completions system;

cementing the outer surface of the casing in position; and providing fluid communication between the sensor and the reservoir with a tool that can be moved through the well to a number of locations.

31. The method of claim 30, wherein the step of providing fluid communication between the sensor and the reservoir includes a device located in the coupling means, said device releasing a substance that promotes one of the event selected from the list:

preventing curing during the setting of the cement;

increasing the permeability of the cement during the setting of the cement; and changing the coefficient of expansion of the cement during curing.

32. The method of claim 30, wherein the step of providing fluid communication between the sensor and the reservoir includes a device located in the coupling means, said device creating shear waves that induce cracks in the cement during curing.

33. The method of claim 30, further comprising the step of positioning an interrogating tool permanently in the internal cavity, said interrogating tool ensuring wireless signal communication with the sensor, wherein signal is of data or power type.

* * * * *